US007757344B2

(12) United States Patent
Min et al.

(10) Patent No.: US 7,757,344 B2
(45) Date of Patent: Jul. 20, 2010

(54) UPRIGHT VACUUM CLEANER

(75) Inventors: Young Gun Min, Changwon-si (KR); Jae Kyum Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 1300 days.

(21) Appl. No.: 11/245,419

(22) Filed: Oct. 7, 2005

(65) Prior Publication Data

US 2007/0079473 A1 Apr. 12, 2007

(51) Int. Cl.
*A47L 9/16* (2006.01)

(52) U.S. Cl. ..... 15/353; 15/347

(58) Field of Classification Search ..... 15/353, 15/351, 347, 327.7

See application file for complete search history.

(56) References Cited

U.S. PATENT DOCUMENTS 5,974,622 A * 11/1999 Louis et al. ..... 15/340.2
5,991,972 A * 11/1999 Krebs et al. ..... 15/354
6,766,559 B2 * 7/2004 Roney et al. ..... 15/410
6,782,583 B2 * 8/2004 Oh ..... 15/350
7,140,068 B1 * 11/2006 Vander Baan et al. ..... 15/347
7,163,568 B2 * 1/2007 Sepke et al. ..... 55/337
7,559,963 B2 * 7/2009 Oh et al. ..... 55/337
2004/0025287 A1 * 2/2004 McCormick et al. ..... 15/353
2005/0050678 A1 * 3/2005 Oh et al. ..... 15/353
2005/0177974 A1 * 8/2005 Conrad et al. ..... 15/353
2007/0079473 A1 * 4/2007 Min et al. ..... 15/353
2007/0079474 A1 * 4/2007 Min et al. ..... 15/353

* cited by examiner

*Primary Examiner*—Lee D Wilson
(74) *Attorney, Agent, or Firm*—KED & Associates, LLP

(57) ABSTRACT

A vacuum cleaner is provided that includes a cleaner body, a multi cyclonic (including a primary cyclone and at least one secondary cyclone), a suction source having a suction source inlet and a suction source outlet, a main filter assembly including a main filter element, a discharge member having an opened upper end coupled to a peripheral edge of a primary airflow outlet and a closed lower end, and a guide rib provided at the primary cyclone for guiding the airflow in a direction tangential to an inner peripheral wall surface of the primary cyclone.

20 Claims, 9 Drawing Sheets

UPRIGHT VACUUM CLEANER

BACKGROUND OF THE INVENTION

1. Field of the Invention

The present invention relates to vacuum cleaners. More particularly, the present invention relates to upright vacuum cleaners used for suctioning dirt and dust from carpets and floors.

2. Discussion of the Related Art

Upright vacuum cleaners are known to include a cleaner body having a handle, by which an operator of the vacuum cleaner may grasp and maneuver the cleaner, and a nozzle section which travels across a floor, carpet, or other surfaces being cleaned.

The cleaner body is often formed as a rigid plastic housing which encloses a dirt and dust collecting filter bag. The nozzle section is hingedly connected to the cleaner body such that the cleaner body is pivotable between a generally vertical upright storage position and an inclined operative position. The underside of the nozzle section includes a suction opening formed therein which is in fluid communication with the filter bag.

A suction source such as a motor and fan assembly is enclosed either within the nozzle section or the cleaner body of the cleaner. The suction source generates the suction force required to pull dirt from the carpet or floor through the suction opening and into the filter bag.

To avoid the need for vacuum filter bags, and the associated expense and inconvenience of replacing the bag, another type of upright vacuum cleaner utilizes cyclonic airflow, rather than a filter bag, to separate a majority of the dirt and other particles from the suction airflow. The air is then filtered to remove residual particles, returned to the motor, and exhausted.

Such prior cyclonic airflow upright vacuum cleaner has a problem in that the airflow passes through a cyclonic chamber without being filtered.

Also, in the conventional vacuum cleaner having the above-mentioned configuration, there is a problem in that a height of the agitator does not be controlled easily in the floor cleaning mode.

Accordingly, it has been deemed desirable to develop a new and improved upright vacuum cleaner which would overcome the foregoing difficulties and others while providing better and more advantageous overall results.

SUMMARY OF THE INVENTION

According to the present invention, a new and improved upright vacuum cleaner is provided.

An object of the present invention is to provide a vacuum cleaner which has a simple coupling structure, and is convenient in use.

Another object of the present invention is to provide a vacuum cleaner having a height adjustment device capable of preventing deterioration of a surface force and improving cleaning performance by controlling a gap between the nozzle section and the surface being cleaned.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein.

In accordance with the first aspect of this invention, a vacuum cleaner comprises a cleaner body, a multi cyclonic chamber being in fluid communication with the cleaner body, a suction source having a suction source inlet and a suction source outlet, a main filter assembly being located in the cleaner body for filtering contaminants from the airflow that passes through the cyclonic chamber and including a main filter element comprising a selectively permeable material, a discharge member having an opened upper end and a closed lower end, and a guide rib provided at the primary cyclone for guiding the airflow in a direction tangential to the inner peripheral wall surface of the primary cyclone.

The multi cyclonic chamber comprises a primary cyclone having a primary airflow inlet and a primary airflow outlet for separating contaminants from the airflow, and at least one secondary cyclone for separating contaminants entrained in the airflow discharged from the primary cyclone.

The suction source is operative to generate and maintain the airflow flowing from the suction source inlet to the suction source outlet and is located in the cleaner body below the multi cyclonic chamber.

The opened upper end of the discharge member is coupled separably to the peripheral edge of the primary airflow outlet.

The guide rib is inclined to one side of the primary airflow inlet according to a shape of the discharge member.

The discharge member has a substantially conical structure.

The secondary cyclone is disposed around the primary cyclone.

The vacuum cleaner further comprises a dust collecting container including a primary dust storing part for storing contaminants separated in the primary cyclone, and a secondary dust storing part for storing contaminants separated in the secondary cyclone.

The primary dust storing part is separated from the secondary dust storing part airtightly.

The vacuum cleaner further comprises a bottom panel covering an open end of the dust collecting container.

The vacuum cleaner may further comprise an auxiliary filter assembly disposed downstream from the main filter assembly.

In accordance with another aspect of the present invention, a vacuum cleaner comprises a nozzle section including a suction opening, a cleaner body hingedly mounted on the nozzle section, a height adjustment device mounted in the nozzle section for adjusting the height of the nozzle section, a handle extending upward from the cleaner body for maneuvering the vacuum cleaner, a multi cyclonic chamber being in fluid communication with the suction opening, the multi cyclonic chamber comprising a primary cyclone for separating contaminants from an airflow and at least one secondary cyclone for separating contaminants entrained in the airflow discharged from the primary cyclone, a suction source having an suction source inlet in fluid communication with the secondary cyclone and an suction source outlet in fluid communication with the atmosphere, a main filter assembly being located on an upper part of the secondary cyclone and including a main filter element, and an opening defined in a top cover coupled to the multi cyclonic chamber so that the airflow flows out of the multi cyclonic chamber through the opening.

The height adjustment device comprises a height adjustment knob being rotatably mounted in the nozzle section, a sliding member being moved up and down according to an operation of the height adjustment knob, and an operation rod for transmitting an operating force by the height adjustment knob to the sliding member.

The height adjustment device further comprises an elastic member being interposed between a lower surface of the sliding member and the bottom of the nozzle section.

The handle includes an extending rod extended from the cleaner body and a telescopic release lever for controlling the extending rod.

The main filter assembly covers the opening.

The upright vacuum cleaner may further comprise a conduit for fluidically connecting the suction opening to a primary airflow inlet of the primary cyclone.

The upright vacuum cleaner may further comprise a final filter assembly connected in fluid communication with the suction source and adapted for filtering the airflow exhausted by the suction source prior to the airflow being dispersed into the atmosphere, wherein the final filter assembly comprises a high efficiency particulate arrest (HEPA) filter medium and a filter support member supporting the filter medium.

The primary airflow inlet is horizontally oriented and arranged so that the airflow entering the primary cyclone through the primary airflow inlet moves cyclonically within the primary cyclone.

In accordance with a further aspect of the invention, an upright vacuum cleaner comprises a nozzle section including a agitator brush, a cleaner body hingedly connected to the nozzle section, a suction source mounted in one of the nozzle section and the cleaner body, a dust collector positioned in the cleaner body comprising a primary cyclone having a cylindrical shape and at least one secondary cyclone having a cone shape in partial and being integrated with the primary cyclone for separating contaminants from an airflow, a bottom panel covering an open end of the dust collector, and a main filter assembly located in the dust collector for filtering dust and dirt from the airflow discharged form the secondary cyclone.

The secondary cyclones are disposed around the primary cyclone and partitioned each other by side walls of the secondary cyclone.

The dust collector further comprises a dust collecting container including a primary dust storing part and a secondary dust storing part being separated from each other airtightly.

It is to be understood that both the foregoing general description and the following detailed description of the present invention are exemplary and explanatory and are intended to provide further explanation of the invention as claimed.

BRIEF DESCRIPTION OF THE DRAWINGS

The invention may take form in certain components and structures, preferred embodiments of which will be illustrated in the accompanying drawings wherein.

DETAILED DESCRIPTION OF THE PREFERRED EMBODIMENTS

Figure 1:
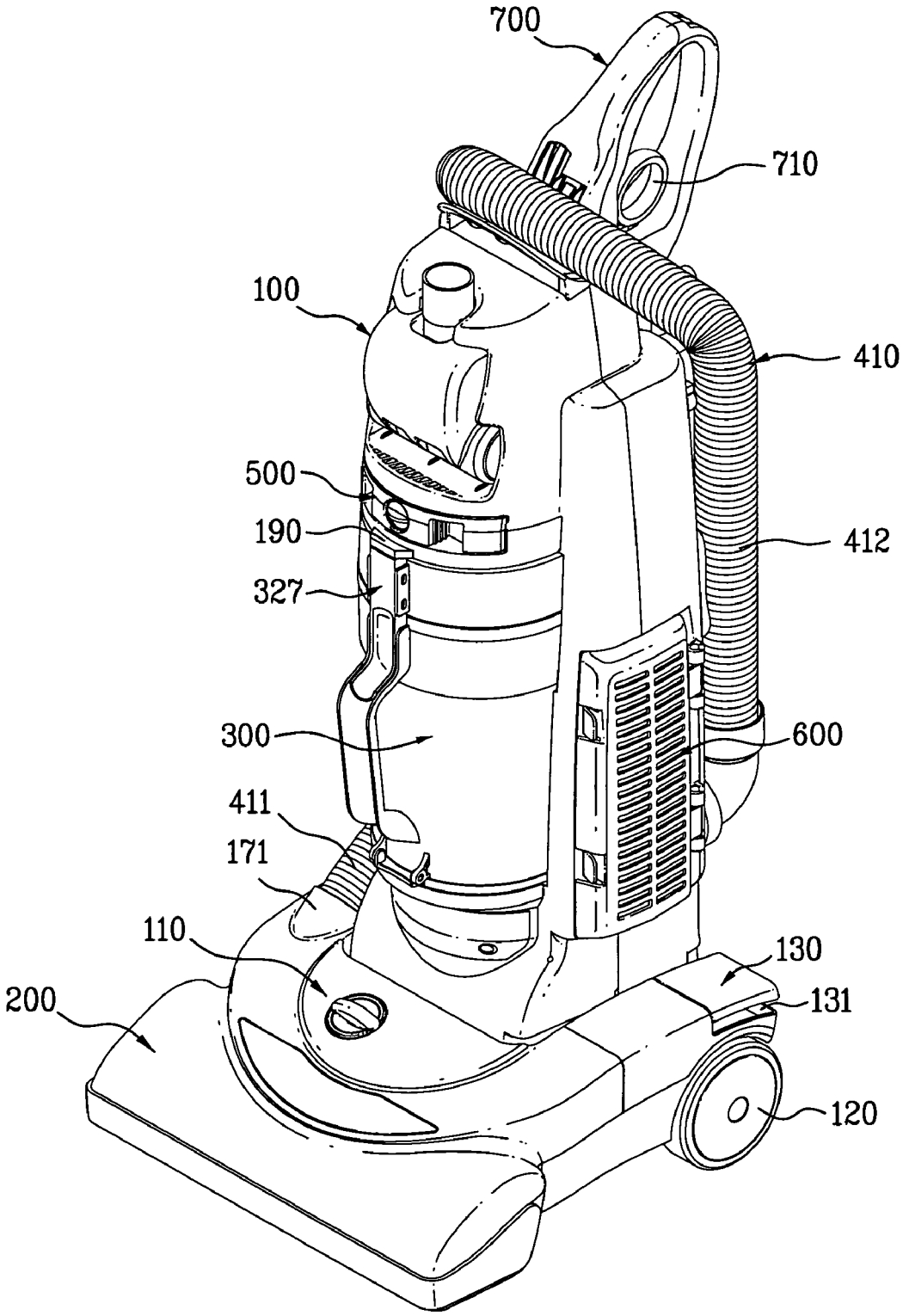
FIG. 1 is a perspective view illustrating a cyclonic airflow upright vacuum cleaner in accordance with the present invention.
Figure 2:
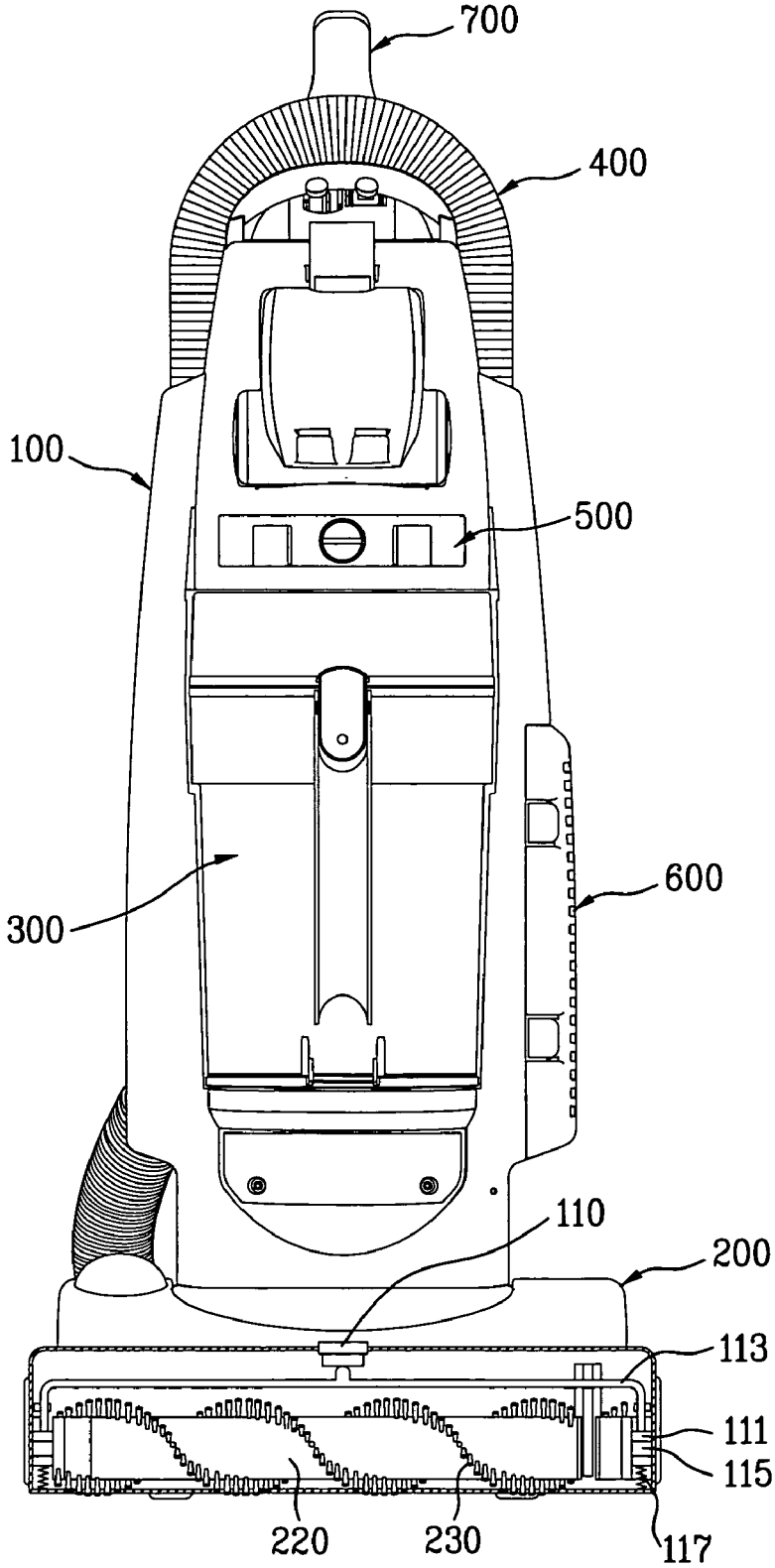
FIG. 2 is a partially dissected front view of the vacuum cleaner shown in FIG. 1.
Figure 3:
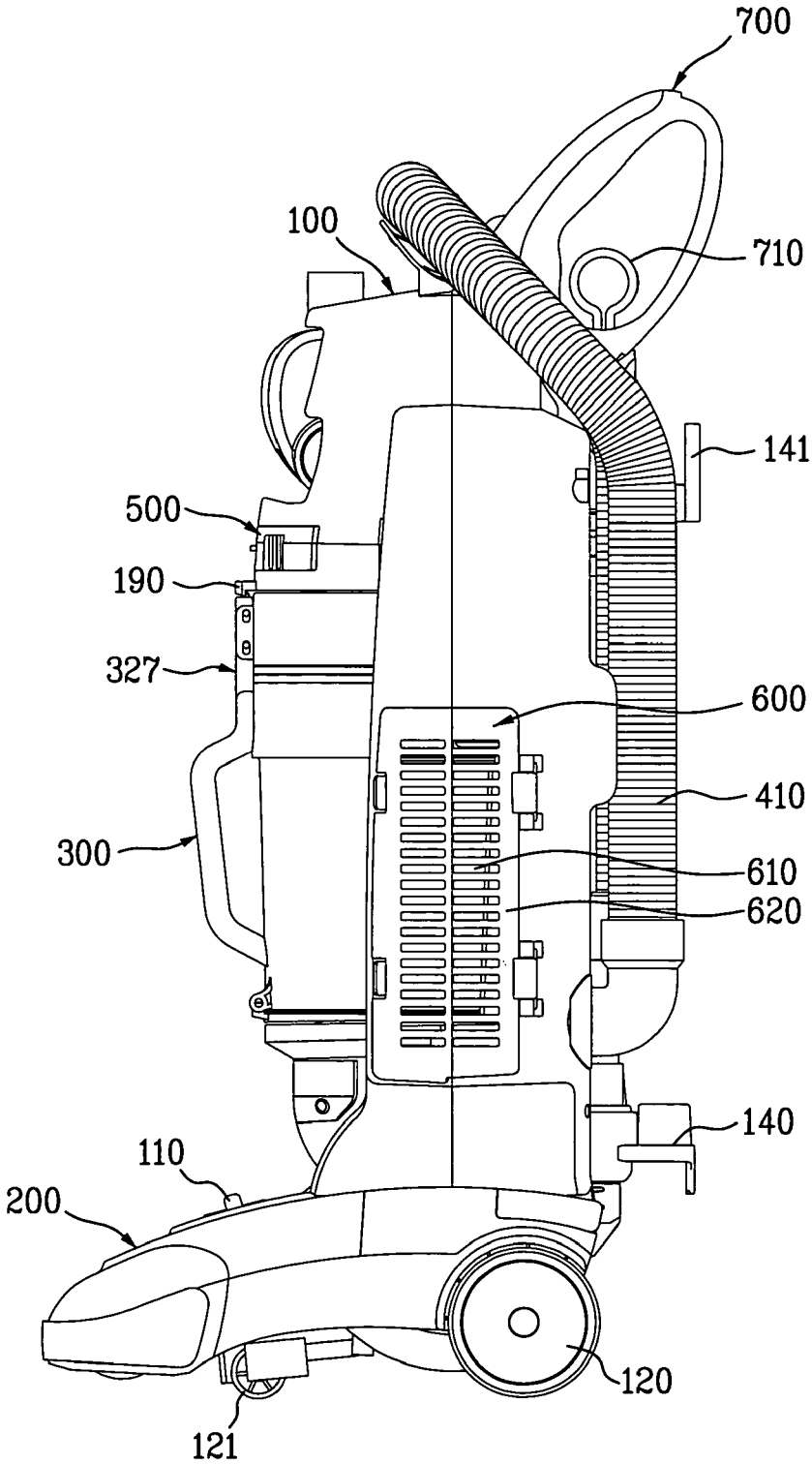
FIG. 3 is a side view of the vacuum cleaner of FIG. 1.
Figure 4:
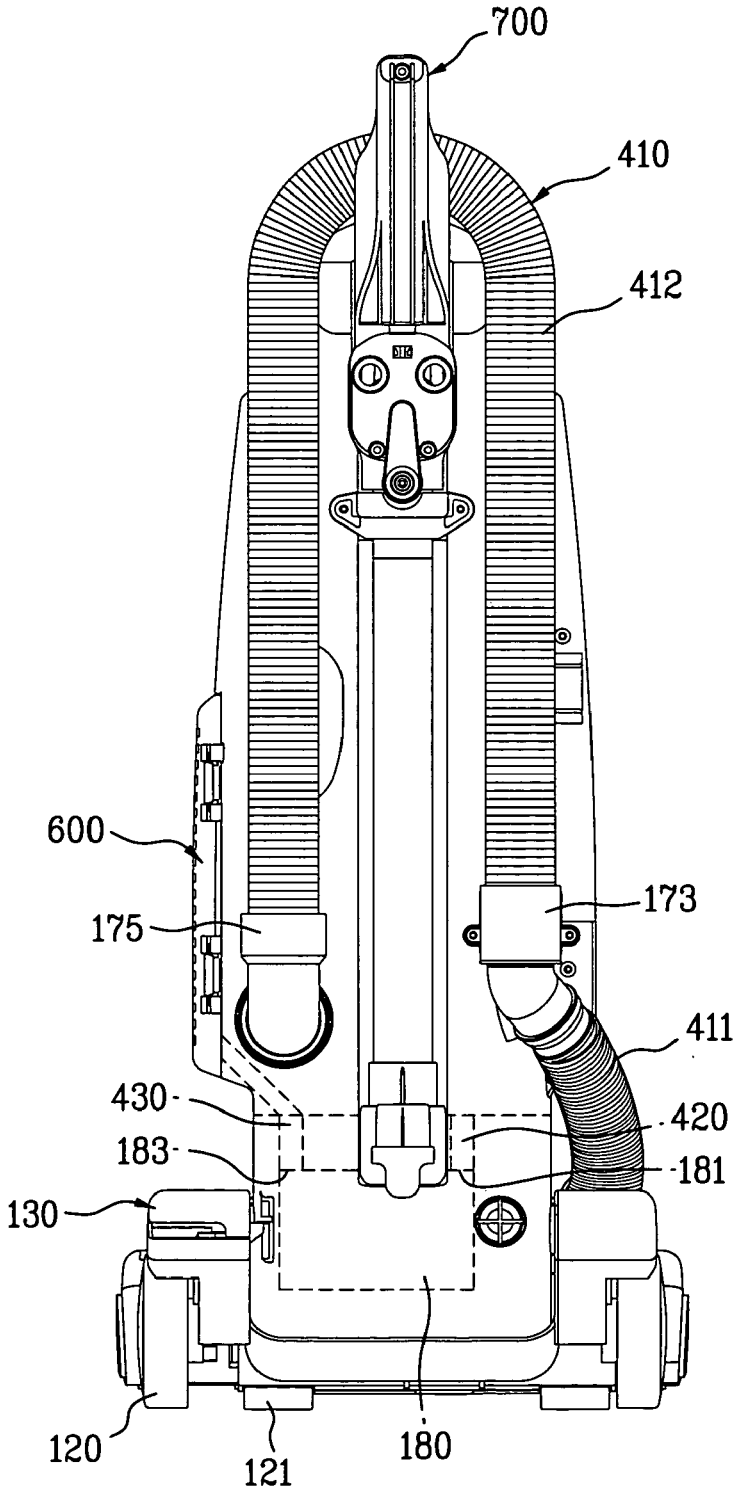
FIG. 4 is a rear view of the vacuum cleaner of FIG. 1.
Figure 5:
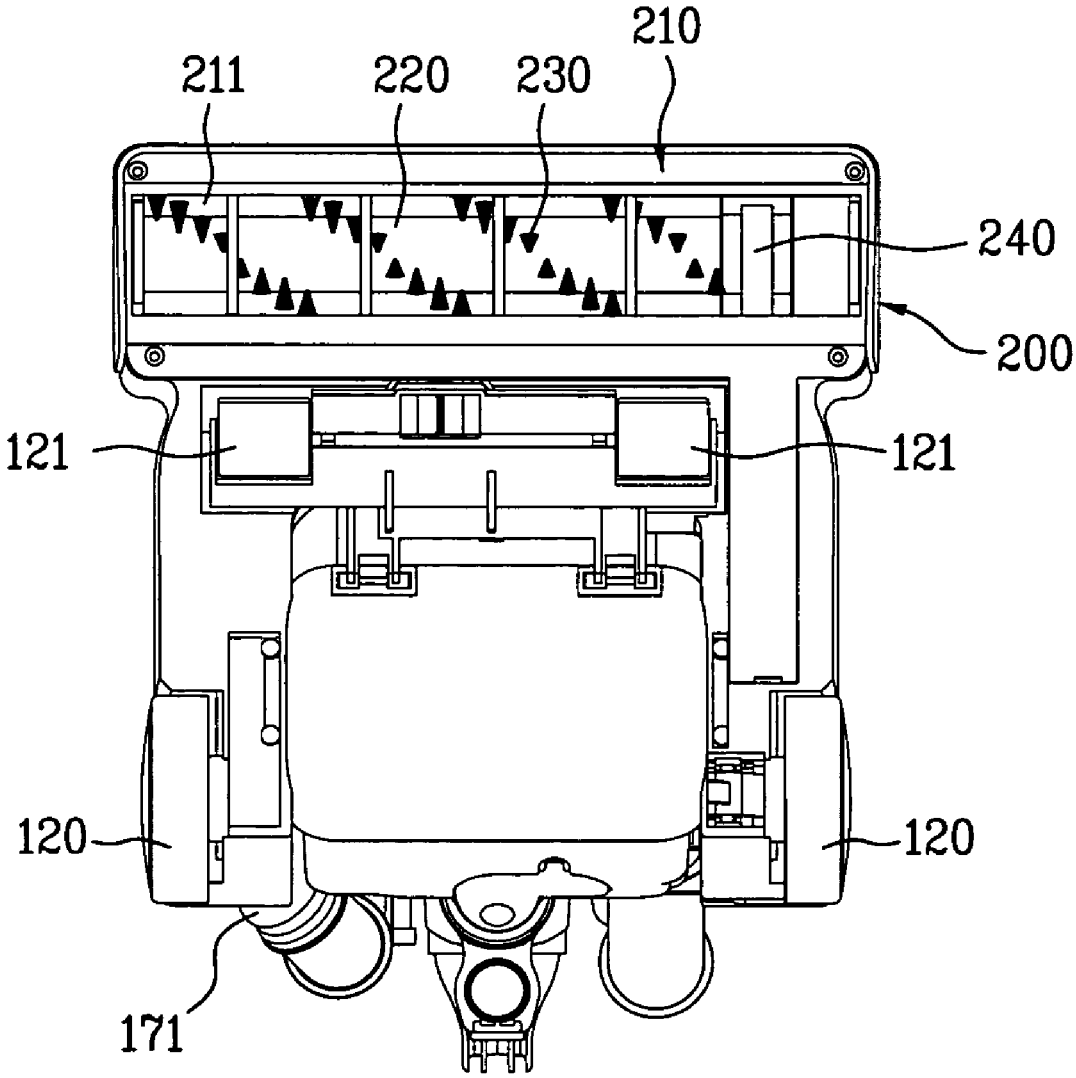
FIG. 5 is a bottom plan view of the vacuum cleaner of FIG. 1.
Figure 6:
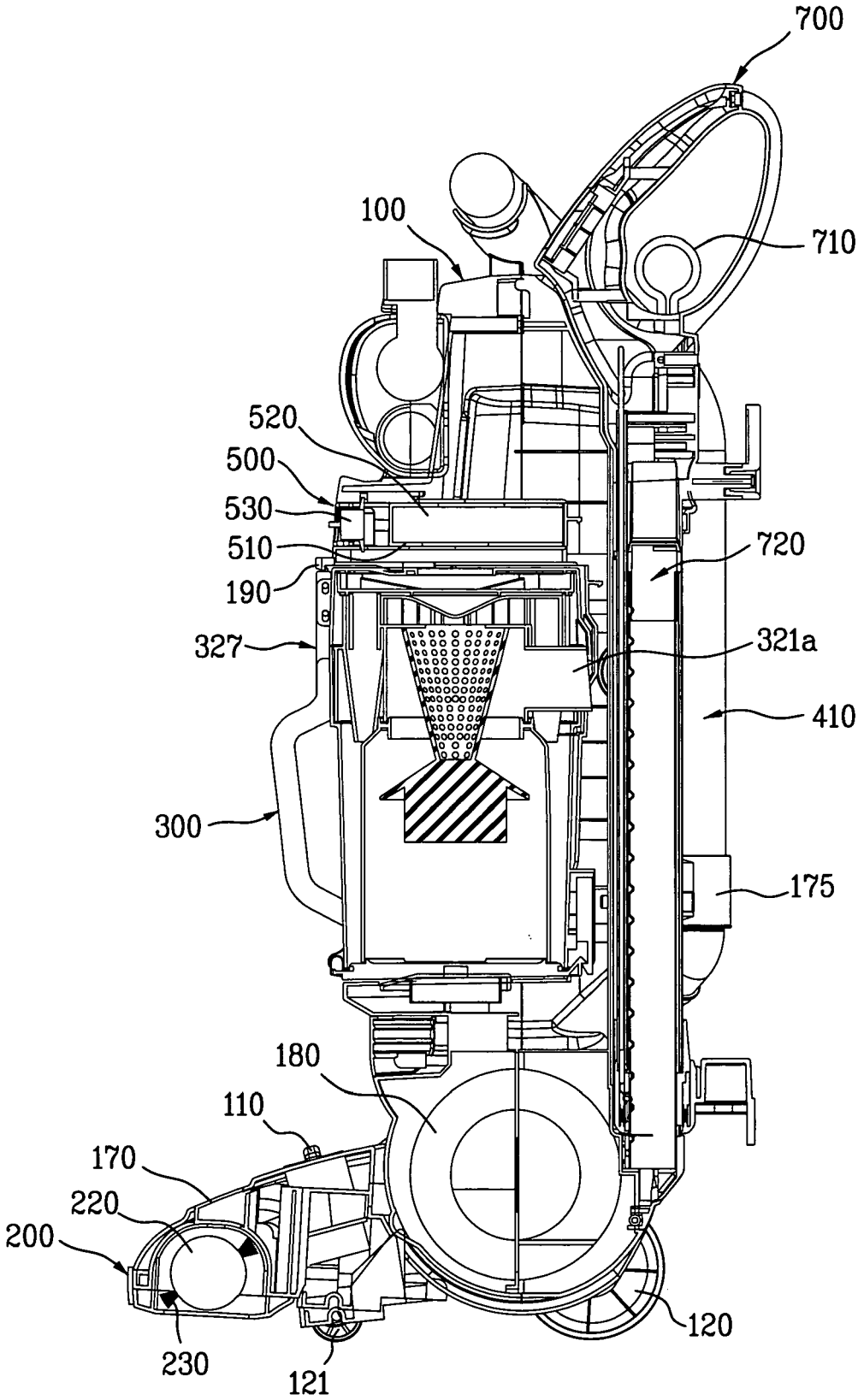
FIG. 6 is a partial side view in cross-section of the vacuum cleaner illustrated in FIG. 1.

Reference will now be made in detail to the preferred embodiments of the present invention, examples of which are illustrated in the accompanying drawings.

FIGS. 1-6 illustrate an upright vacuum cleaner including a cleaner body 100, a nozzle section 200 connected to the cleaner body 100, and conduits for guiding the suction airflow from the nozzle section 200 to the atmosphere through the cleaner body 100.

The cleaner body 100 and the nozzle section 200 are pivotally or hingedly connected through the use of suitable hinge assembly so that the cleaner body 100 pivots between a generally vertical storage position (as shown) and an inclined operative position.

The nozzle section 200 includes a nozzle case 210, a suction opening 211 which formed at the underside of the nozzle case 210, and a rotating brush assembly which provided in the nozzle case 210. Front wheels 121 and rear wheels 121 are rotatably mounted to underside of the nozzle case 210, respectively, to enable the nozzle section 200 to smoothly move on a floor.

The suction opening 211 extends substantially across the width of the nozzle case 210 at the front end thereof. And, the suction opening 211 is in fluid communication with the cleaner body 100 through a first conduit 410.

The rotating brush assembly includes an agitator 220, an agitator brush 230 which provided at the outer circumference of the agitator 220, and a belt 240 for transferring the rotational force of a suction source 180 to the agitator 220.

The agitator 220 and the agitator brush 230 are positioned in the region of the suction opening 211 for contacting and scrubbing the surface being vacuumed to loosen embedded dirt and dust. That is, when the rotational force of the suction source 180 is transferred to the agitator 220, the agitator 220 rotates and brushes up contaminants from the surface being cleaned. The rotating brush assembly may further include an agitator motor (not shown) for driving the agitator 220.

A height adjustment device provided at the nozzle section includes a height adjustment knob 110 being rotatably mounted in the nozzle section 200, a sliding member 111 supporting a hinge shaft 115 prolonged from both end portion of the agitator 220, an operation rod 113 for transmitting an operating force by the height adjustment knob 110 to the sliding member 111.

Also, an elastic member 117 is interposed between the lower surface of the sliding member 111 and the bottom of the nozzle case 210.

In case of cleaning a carpet, when a user rotates the height adjustment knob 110 with his/her hand, the operation rod 113 is descended, and thus presses the sliding member 111. Due to the pressing, the sliding member 111 overcomes an elastic force of the elastic member 117, and is linearly moved downwardly. Then, the agitator 220 is descended and thus the agitator brush 230 comes in contact with the carpet. It is preferred that the height adjustment knob 110 is capable of adjusting the height of the agitator 220 step by step and in accordance with the state of the surface to be cleaned.

The cleaner body 100 includes a control part (not shown) for controlling the vacuum cleaner, the suction source 180 for generating the required suction airflow for cleaning operations, and a dust collector 300 for separating contaminants entrained in the suction airflow passed through the suction opening 211. The cleaner body 100 may further comprise a coupling device including a latch 327 and a coupling protrusion 190 for coupling the dust collector 300 to the cleaner body 100.

The suction source 180 including an electronic motor and a fan generates a suction force in a suction source inlet 181 and an exhaust force in a suction source outlet 183. The suction source outlet 183 is in fluid communication with a final filter assembly 600 for filtering the exhaust airflow of any contaminants immediately prior to its discharge into the atmosphere. The suction source inlet 181 is in fluid communication with the dust collector 300 of the cleaner body 100. Of course, the suction source could be disposed in the nozzle section 200.

The cleaner body 100 further includes a handle 700 by which a user of the vacuum cleaner is able to grasp and maneuver the vacuum cleaner. The handle 700 includes an extending rod 720 being extendable according to a height of the user and a telescopic release lever 710 for controlling the extending rod 720.

When the user wants to raise the handle 700, the user pulls the telescopic release lever 710 up with fingers and pulls up the handle 700. To take down the handle 700, the user pulls the telescopic release lever 710 up with fingers and pulls down the handle 700.

The cleaner body 100 further includes a cord hook provided at rear side of the cleaner body 100. The cord hook includes an upper cord hook 141 and a lower cord hook 140 corresponding to the upper cord hook. The space between the upper cord hook 141 and the lower cord hook 140 is sufficient to accommodate the number of turns necessary to store the entire length of the cord. A cord holder (not shown) adjacent to the cord hook prevents the cord releasing from its stored position.

The conduits include a first conduit 410 connecting the suction opening 211 to dust collector 300, a second conduit 420 connecting the dust collector 300 to the suction source inlet 181, and a third conduit 430 connecting the suction source outlet 183 to the atmosphere.

The first conduit 410 including hoses is supported and connected by fitting members. One side of a first fitting member 171 is connected to a first hose 411 and the other side of the first fitting member 171 is connected to a passage 170 which is in fluid communication with the suction opening 211.

A second fitting member 173 connects the first hose 411 to a second hose 412 and a third fitting member 175 connects the second hose 412 to the cleaner body. Each of first and second hose (411, 412) is connected detachably to the second fitting member 173.

The vacuum cleaner further includes body release pedal 130 for an inclined operative position of the vacuum cleaner. The body release pedal 130 is pivotably mounted on a mounting portion 131 which is provided at the nozzle section.

Hereinafter, the structures of the dust collector will be described in detail with reference to FIGS. 7-9.

Figure 7:
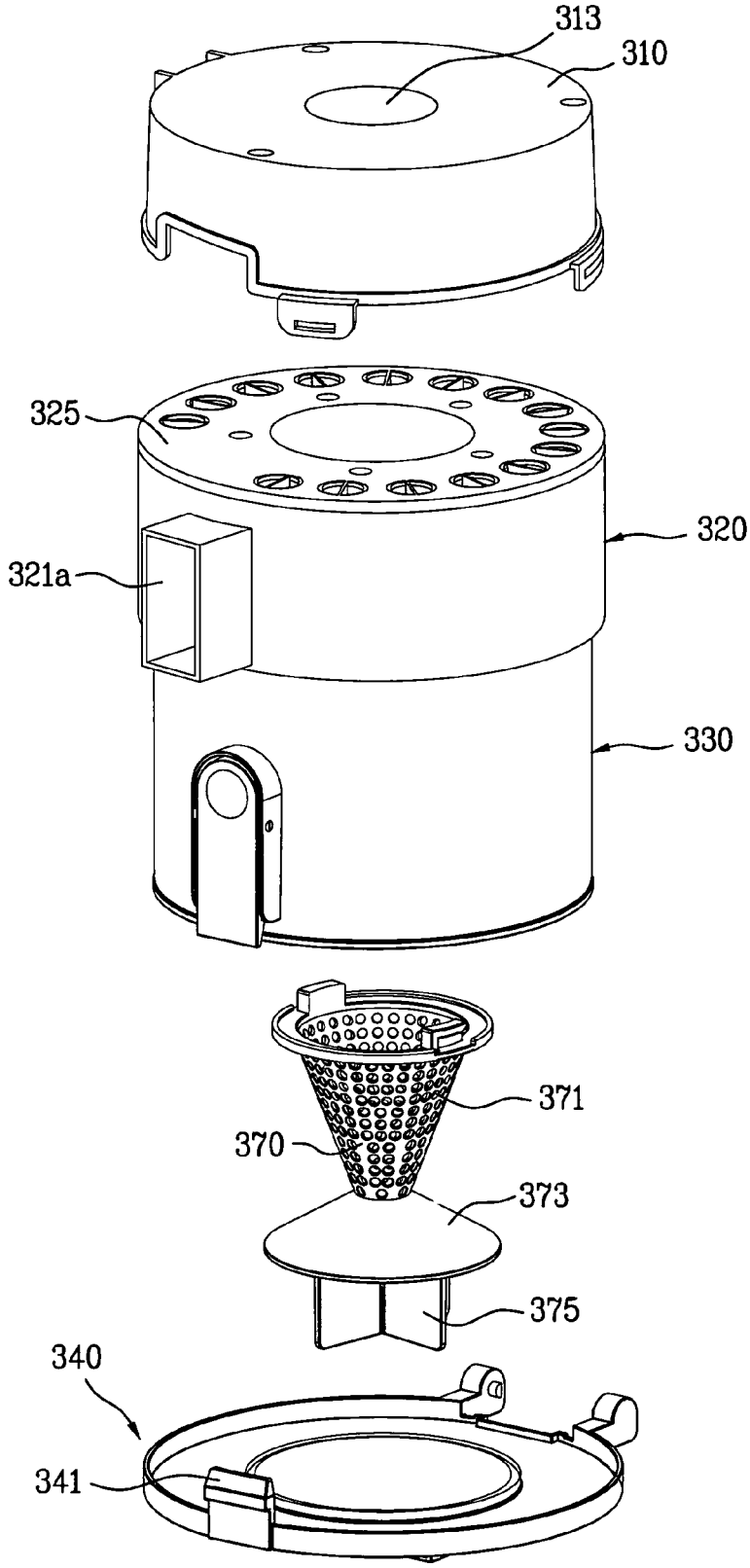
FIG. 7 is an exploded perspective view of the dust collector illustrated in FIG. 1.
Figure 8:
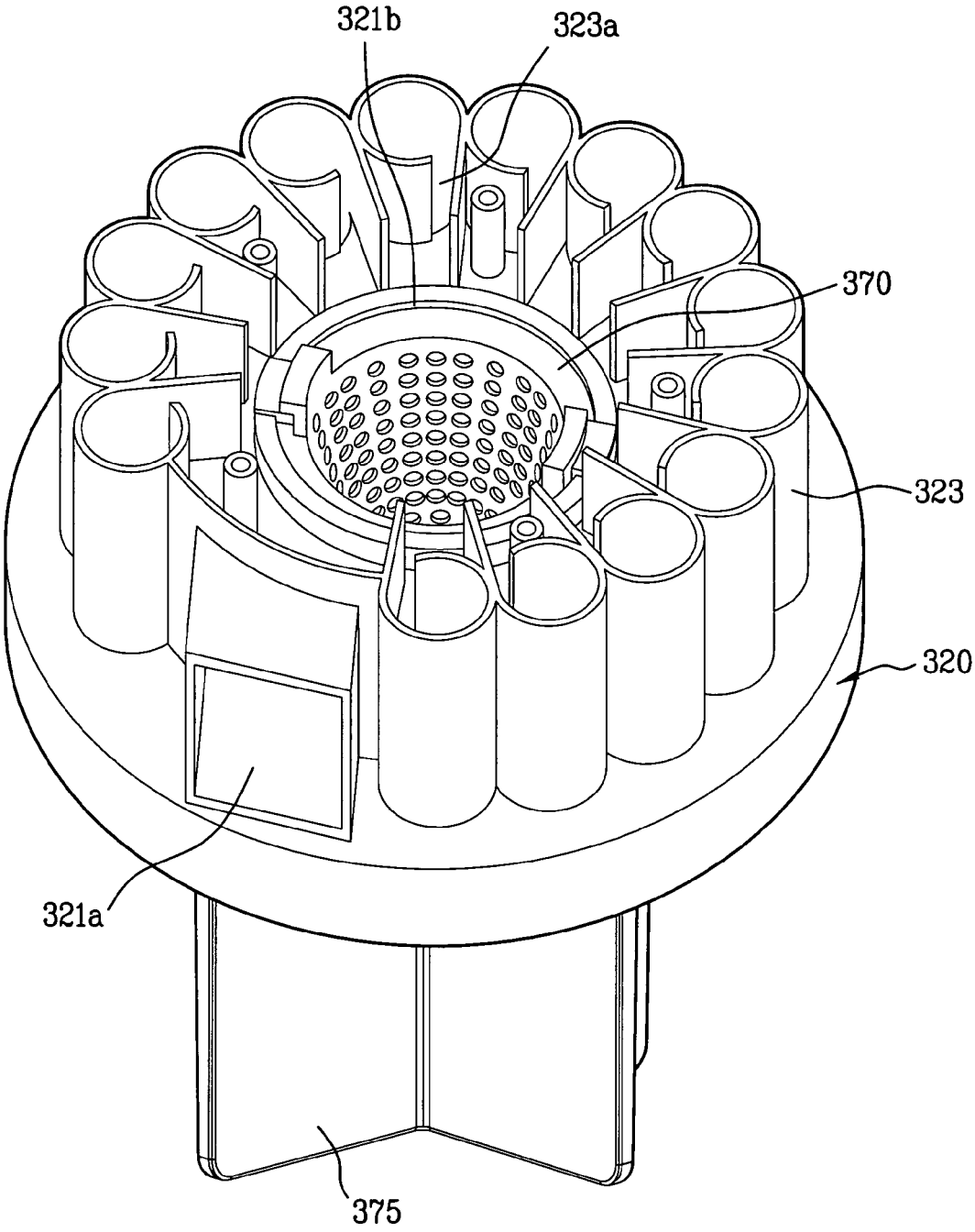
FIG. 8 is a perspective view illustrating an upper part of the dust collector illustrated in FIG. 7.
Figure 9:
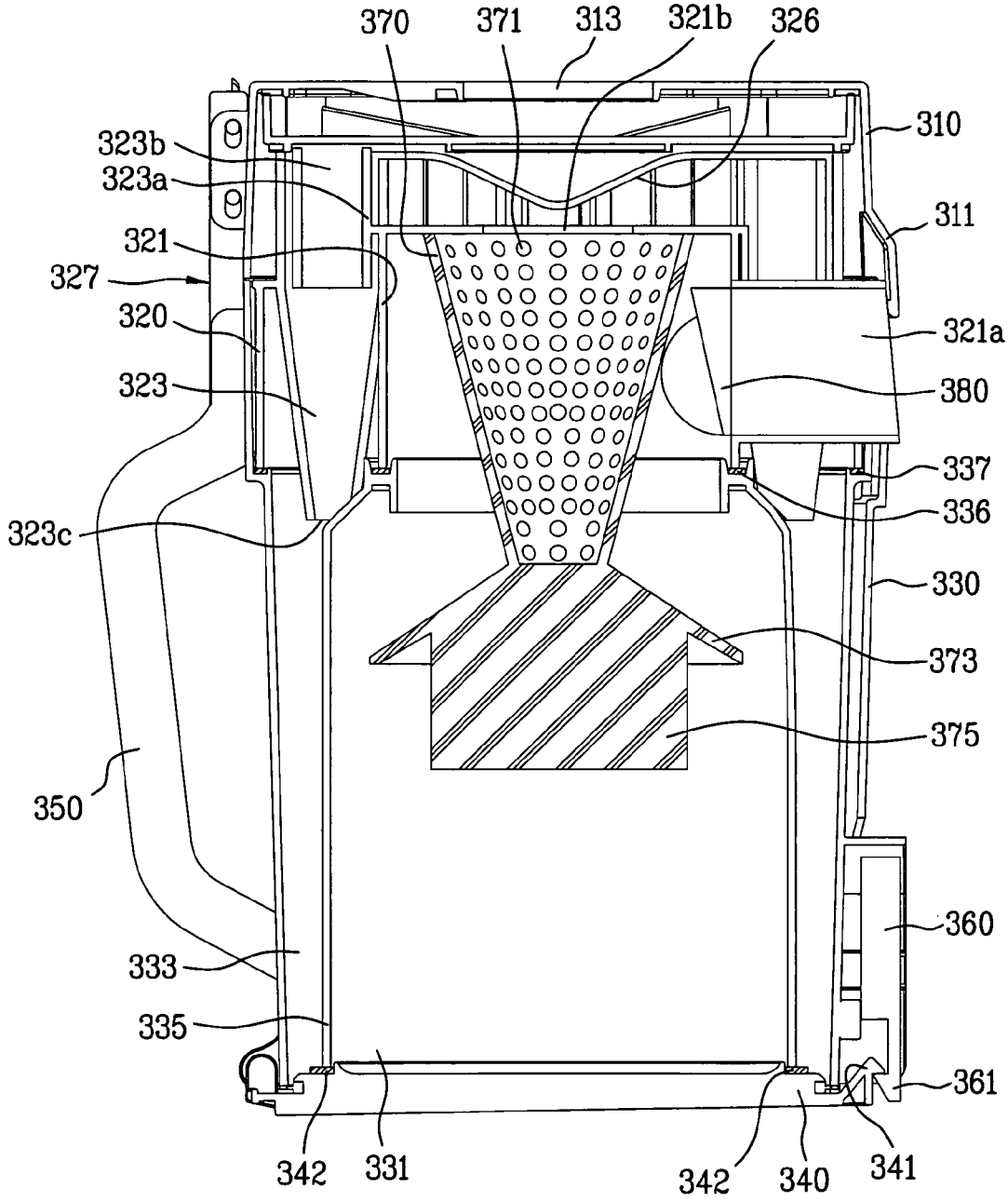
FIG. 9 is a partial side view in cross-section of the dust collector illustrated in FIG. 7

Referring to the FIGS. 7-9, the dust collector 300 comprises a cyclonic chamber 320, a dust collecting container 330, a bottom panel 340 which is positioned at lower end of the dust collecting container 330 and a top cover 310 which is positioned at upper end of the dust collecting container 330 and detachably connected to the dust collecting container 330.

The dust collector 300 further includes a dust collector handle 350 which is provided on the exterior of the dust collecting container 330 for handling the container. For coupling the dust collector to the cleaner body, the latch 327 is positioned at the upper end of the dust collector handle 350 and the coupling protrusion 190 is formed at the front portion of the cleaner body.

The cyclonic chamber 320 includes a primary cyclone 321 and at least one secondary cyclone 323. The primary cyclone 321 separates dust and dirt from the suction airflow passed through the suction opening 211. The secondary cyclone 323 separates dust and dirt entrained in the airflow discharged form the primary cyclone 321.

The primary cyclone 321 has a downwardly-opened cylindrical container shape. A primary airflow inlet 321*a* is formed through an upper portion of the primary cyclone 321 at one side of the primary cyclone 321. A primary airflow outlet 321*b* is formed through the top of the primary cyclone 321 such that the primary airflow outlet 321*b* extends vertically.

The primary airflow inlet 321*a* is tangentially oriented and arranged so that the airflow entering the primary cyclone 321 through the primary airflow inlet 321*a* moves cyclonically within the primary cyclone 321. That is, the primary airflow inlet 321*a* guides dirt-laden air into the cyclonic chamber 320 in a tangential direction of the primary cyclone 321 so that the air flows spirally along an inner wall surface of the primary cyclone 321.

The secondary cyclones 323 are partitioned each other by peripheral walls of the secondary cyclones 323.

In particular, the secondary cyclones 323 are circumferentially arranged around the primary cyclone 321. Each secondary cyclone 323 has an upper end upwardly protruded to a level higher than that of the upper end of the primary cyclone 321.

The peripheral wall of each secondary cyclone 323 is vertically cut out at a region where the peripheral wall is upwardly protruded above the upper end of the primary cyclone 321, thereby forming a secondary airflow inlet 323*a* communicating with the primary airflow outlet 321*b*.

Each secondary cyclone 323 also has a cone shape in partial. That is, the secondary cyclone 323 has a conical portion formed at a lower portion of the secondary cyclone 323 such that the conical portion has a diameter reduced gradually as the conical portion extends toward the bottom of the dust collecting container 330.

A contaminants discharge port 323*c* is formed at a lower end of each secondary cyclone 323 to downwardly discharge contaminants such as dust.

The secondary cyclones 323 have an integrated structure such that adjacent ones of the secondary cyclones 323 are in contact with each other to prevent air from being leaked between the adjacent secondary cyclones 323.

The cyclonic chamber 320 may further include a chamber cover 325 mounted to the upper end of the cyclonic chamber 320 to open or close the upper ends of the secondary cyclones 323.

The secondary airflow inlet 323*a* of each secondary cyclone 323 guides air discharged from the primary airflow outlet 321*b* to flow in a tangential direction of the secondary cyclone 323 so that the air entering the secondary airflow inlet 323*a* flows spirally along an inner wall surface of the secondary cyclone 323.

Secondary airflow outlets 323*b* are formed at the chamber cover 325 along the peripheral portion of the chamber cover 325 to discharge air from the secondary cyclones 323, respectively.

The dust collecting container 330 is disposed under the cyclonic chamber 320. Dust separated in the primary cyclone 321 and second cyclones 323, which have the above-described configurations, respectively, is stored in a dust storing part formed by the dust collecting container 330.

The dust storing part includes a primary dust storing part 331 for storing the dust separated by the primary cyclone 321, and a secondary dust storing part 333 for storing dust separated by the secondary cyclones 323. A sealing member (336, 337) is positioned between the dust collecting container 330 and the cyclonic chamber 320 for preventing a leakage in the cyclonic chamber 320.

The stored dust is subsequently outwardly discharged by virtue of gravity when the bottom panel 340 is opened. An opening/closing device 360 is mounted to the peripheral wall of the dust collecting container 330 to open or close the bottom panel 340. The opening/closing device 360 includes a locking hook 361 for locking the bottom panel 340. Also, the bottom panel 340 includes a mating hook 341 corresponding to the locking hook 361.

The dust collecting container 330 is preferably at least partially transparent so that an operator of the vacuum cleaner is able to view the level of dirt and dust accumulated therein for purposes of determining when the dust collecting container 330 should be emptied.

The primary dust storing part 331 and secondary dust storing part 333 are partitioned by a substantially cylindrical boundary wall 335, which is connected to the secondary cyclones 323, and has a diameter smaller than that of the peripheral wall of the dust collecting container 330.

The boundary wall 335 has a lower end extending downward to the bottom of the dust collecting container 330, that is, the upper surface of the bottom panel 340, beyond the lower end of the primary cyclone 321.

A sealing member 342 is mounted between the boundary wall 335 and the bottom panel 340. The sealing member 342 having a cylindrical shape is made elastic material. Accordingly, the sealing member 342 prevents the primary dust storing part 331 from communicating with the secondary dust storing parts 333.

In addition to the above-described configuration, the dust collector 300 according to the illustrated embodiment of the present invention further includes a discharge member 370 mounted on the upper end of the primary cyclone 321. Plurality of holes 371 are formed at a peripheral wall of the discharge member 370, in order to allow the discharge member 370 to communicate with the primary airflow outlet 321*b* of the primary cyclone 321.

It is preferred that the discharge member 370 be centrally arranged in the primary cyclone 321, extend axially through the primary cyclone 321, and have a substantially conical structure having an opened upper end and a closed lower end while having a diameter gradually reduced as the discharge member 370 extends downward.

When the discharge member 370 has such a structure, the velocity of the spiral air flow in the primary cyclone 321 is gradually reduced toward the lower end of the primary cyclone 321. Therefore, it is possible to prevent dust from being influenced by a suction force exerted in the discharge member 370.

The upper end of the discharge member 370 is coupled separably with the peripheral edge of the primary airflow outlet 321*b*. An annular sealing member (not shown), which provides a sealing effect, is interposed between the upper end of the discharge member 370 and the primary airflow outlet 321*b*.

A floatation prevention member 373 may also be mounted to the lower end of the discharge member 370, in order to prevent the dust collected in the primary dust storing part 331 from rising due to the spiral air flow, and thus, from entering the secondary cyclones 323.

For such a function, it is preferred that the floatation prevention member 373 have a radially-extending structure formed integrally with the lower end of the discharge member 370. It is also preferred that the floatation prevention member 373 has a downwardly-inclined upper surface. Specifically, the floatation prevention member 373 has a conical structure having a diameter gradually increased as the floatation prevention member 373 extends downward.

Also, it is preferred that a cross blade 375 is attached under the floatation prevention member 373 for preventing swirling airflow in the primary dust storing part 331 additionally. If there is no cross blade 375, then the air turbulence will occur causing more dust to rise up. Of course, the structure of the floatation prevention member 373 does not be restricted in this embodiment.

The dust collector 300 also includes a guide rib 380 provided at the primary cyclone 321. The guide rib 380 is inclined to one side of the primary airflow inlet 321*a* according to a shape of the discharge member.

The guide rib 380 guides air entering the primary airflow inlet 321*a* to flow in a direction tangential to the inner peripheral wall surface of the primary cyclone 321. That is, the guide rib 380 prevents the air entering the primary airflow inlet 321*a* from being directly introduced into the discharge member 370.

Meanwhile, a main filter assembly 500 located on the dust collector 300 for filtering contaminants from the airflow discharged form the secondary cyclone 323.

The main filter assembly 500 includes a filter housing 510 and a main filter element 520 mounted in the filter housing 510 and a filter housing knob 530 for handling the filter housing.

The filter housing 510 coupled detachably to the cleaner body 100 receives and retains the main filter element 520. The filter housing 510 includes a plurality of apertures, slots, or other passages formed therethrough, preferably in the lower half thereof, so that the suction airflow flows freely from the cover discharge port 313 into the filter housing 510 and to the main filter element 520.

It is preferable that the main filter element 520 is made of permeable material. For cleaning the main filter element 520, the user is able to detach the filter housing 510 from the cleaner body by rotating and drawing out the filter housing knob 530.

The preferred main filter element 520 comprises Porex® brand high density polyethylene-based open-celled porous media available commercially from Porex Technologies Corp., Fairburn, Ga. 30213, or an equivalent foraminous filter member. This preferred main filter element 520 is a rigid open-celled foam that is moldable, machinable, and otherwise workable into any shape as deemed advantageous for a particular application.

The main filter assembly 500 may further include a filter support member (not shown) for supporting and fixing the main filter element 520. The filter support member is formed at the inner frame of the filter housing.

The cleaner body 100 also comprises a final filter assembly 600 for filtering the suction airflow immediately prior to its exhaustion into the atmosphere. The preferred final filter assembly 600 includes a final filter element 610 and a final filter housing 620 for retaining the final filter element.

The final filter element 610 is preferably a high efficiency particulate arrest (HEPA) filter element in a sheet or block form. The final filter housing 620 has protective grid or grate structure for securing the final filter element 610 in place.

Those skilled in the art will recognize that the final filter assembly 600 will remove the contaminant such that only contaminant-free air is discharged into the atmosphere.

The vacuum cleaner may further include an auxiliary filter assembly (not shown) disposed downstream from the main filter assembly. The auxiliary filter assembly includes an auxiliary filter element (not shown), a filter supporter for supporting and installing the auxiliary filter element, and an auxiliary filter housing (not shown) for retaining the auxiliary filter element.

Operation of the vacuum cleaner, in which the dust collector 300 according to the illustrated embodiment of the present invention is incorporated, will now be described referring to FIGS. 1-9.

When the vacuum cleaner operates, the suction source 180 establishes a suction force at its suction source inlet 181, in the elongated the first conduit 410, and thus in the primary cyclone 321.

This suction force or negative pressure in primary cyclone 321 is communicated to the suction opening 211 formed in the nozzle underside through the hoses and associated fitting members. This, then, in combination with the scrubbing action of the rotating brush assembly causes dust and dirt from the surface being cleaned to be entrained in the suction airflow and pulled into the primary cyclone 321 through the primary airflow inlet 321*a*.

The air introduced into the primary cyclone 321 is guided by the guide rib 380 to flow in a direction tangential to the inner peripheral surface of the primary cyclone 321 without being directly introduced into the discharge member 370, thereby forming a spiral flow.

In the instance, the air acquires a certain swirling force, and the swirling force separates heavy and large dust particles. As a result, relatively heavy and large dust is separated from the air in accordance with the cyclone principle, and is then stored in the primary dust storing part 331 after falling downward.

The dust stored in the primary dust storing part 331 is prevented from floating in accordance with the functions of the floatation prevention member 373 and corrugated boundary wall 335.

The air, from which relatively heavy and large dust has been separated, is discharged from the primary cyclone 321 through the primary airflow outlet 321*b* communicating with the holes 371 formed at the peripheral wall of the discharge member 370.

The finer dust is then filtered through the discharge member 370 placed between the primary cyclone 321 and the secondary cyclones 323. Also, the air is then introduced into the secondary cyclones 323 so that the air is again subjected to a dust separation process, in order to separate relatively light and fine dust from the air.

The air, from which relatively light and fine dust has been separated in the secondary cyclones 323, is introduced into the interior of the top cover 310 through the secondary airflow outlets 323*b*. The air introduced into the interior of the top cover 310 is discharged through a cover discharge port 313 formed at the center of the top cover 310. The air emerging from the cover discharge port 313 is introduced into the main filter assembly 500.

Then, the air passes through the apertures formed in the filter housing 510, passes through the main filter element 520 so that residual contaminants are removed, and exits the main filter assembly 500. The air discharging from the main filter assembly 500 is introduced into the suction source 180 through the second conduit 420. Then, the air emerging from the suction source outlet 183 is introduced into the final filter assembly 600 through the third conduit 430.

In the final filter assembly 600, the air is filtered again by the HEPA filter to remove any contaminants that passed through the dust collector 300 and the main filter assembly 500. The air passed through the final filter assembly 600 outwardly is discharged from the vacuum cleaner to atmosphere.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The above-described vacuum cleaner according to the present invention has various effects.

First, in accordance with the present invention, there is an advantage in that the vacuum cleaner separates easily and conveniently dust and dirt from the airflow and deposits the dust and dirt into the dust collecting container.

Second, in accordance with the present invention, there is further advantage in that it is possible to control easily the height of agitator by virtue of the height adjustment device. Accordingly, when cleaning the floor, deterioration of a suction force is prevented, and cleaning efficiency can be improved.

Third, in accordance with the present invention, there is still further advantage in that it is possible to control the height of handle by virtue of the telescopic release lever and the extending rod.

What is claimed is:

1. A vacuum cleaner comprising:

a cleaner body;

a multi cyclonic chamber being in fluid communication with the cleaner body, the multi cyclonic chamber comprising:

a primary cyclone having a primary airflow inlet and a primary airflow outlet for separating contaminants from an airflow, and at least one secondary cyclone for separating contaminants in the airflow discharged from the primary cyclone;

a suction source having a suction source inlet and a suction source outlet, the suction source operative to generate and maintain the airflow flowing from the suction source inlet to the suction source outlet, the suction source being located in the cleaner body below the multi cyclonic chamber;

a main filter assembly including a main filter element having a selectively permeable material, the main filter assembly located in the cleaner body for filtering contaminants from the airflow that passes through the cyclonic chamber;

a discharge member having an opened upper end and a closed lower end, the opened upper end is coupled separably to a peripheral edge of the primary airflow outlet; and a guide rib provided at the primary cyclone for guiding the airflow in a direction tangential to an inner peripheral wall surface of the primary cyclone, wherein the guide rib is inclined to one side of the primary airflow inlet according to a shape of the discharge member to prevent the air entering the primary air flow inlet from being directly introduced into the discharge member, wherein said airflow is further directed into said secondary cyclone which allows said airflow to enter said discharge member from the top of said discharge member.

2. The vacuum cleaner as set forth in claim 1, wherein the discharge member has a substantially conical structure.

3. The vacuum cleaner as set forth in claim 1, wherein the secondary cyclone is disposed around the primary cyclone.

4. The vacuum cleaner as set forth in claim 3, further comprising a dust collecting container including a primary dust storing part for storing contaminants separated in the primary cyclone, and a secondary dust storing part for storing contaminants separated in the secondary cyclone.

5. The vacuum cleaner as set forth in claim 4, wherein the primary dust storing part is airtightly separated from the secondary dust storing part.

6. The vacuum cleaner as set forth in claim 4, further comprising a bottom panel covering an open end of the dust collecting container.

7. The vacuum cleaner as set forth in claim 1, further comprising an auxiliary filter assembly provided downstream from the main filter assembly.

8. An upright vacuum cleaner comprising:

a nozzle section including a suction opening and an agitator;

a cleaner body hingedly mounted on the nozzle section;

a height adjustment device mounted in the nozzle section for adjusting a height of the agitator in the nozzle section;

a handle extending upward from the cleaner body for maneuvering the vacuum cleaner;

a multi cyclonic chamber being in fluid communication with the suction opening, the multi cyclonic chamber comprising:

a primary cyclone for separating contaminants from an airflow, and at least one secondary cyclone for separating contaminants in the airflow discharged from the primary cyclone;

a suction source having an suction source inlet in fluid communication with the secondary cyclone and an suction source outlet in fluid communication with the atmosphere;

a main filter assembly including a main filter element, the main filter assembly is located on an upper part of the secondary cyclone; an opening defined in a top cover coupled to the multi cyclonic chamber, the airflow flowing out of the multi cyclonic chamber through the opening; and a guide rib provided at the primary cyclone for guiding the airflow in a direction tangential to an inner peripheral wall surface of the primary cyclone, wherein the guide rib is inclined to one side of a primary airflow inlet of the primary cyclone according to a shape of a discharge member to prevent the air entering the primary air flow inlet from being directly introduced into the discharge member, wherein said airflow is further directed into said secondary cyclone which allows said airflow to enter said discharge member from the top of said discharge member.

9. The upright vacuum cleaner as set forth in claim 8, wherein the height adjustment device comprises:

a height adjustment knob being rotatably mounted in the nozzle section;

a sliding member to move up and down according to an operation of the height adjustment knob, the sliding member supporting a hinge shaft prolonged from both end portions of the agitator; and an operation rod for transmitting an operating force by the height adjustment knob to the sliding member, wherein the agitator to descend or ascend when the sliding member descends or ascends based on rotation of the height adjustment knob.

10. The upright vacuum cleaner as set forth in claim 9, wherein the height adjustment device further comprises an elastic member interposed between a lower surface of the sliding member and a bottom of the nozzle section.

11. The upright vacuum cleaner as set forth in claim 8, wherein the handle includes an extending rod extended from the cleaner body and a telescopic release lever for controlling the extending rod.

12. The upright vacuum cleaner as set forth in claim 8, wherein the main filter assembly covers the opening.

13. The upright vacuum cleaner as set forth in claim 8, further comprising a conduit for fluidically connecting the opening to the primary airflow inlet of the primary cyclone.

14. The upright vacuum cleaner as set forth in claim 8, further comprising a final filter assembly connected in fluid communication with the suction source and adapted for filtering the airflow exhausted by the suction source prior to the airflow being dispersed into the atmosphere, wherein the final filter assembly comprises a high efficiency particulate arrest (HEPA) filter medium and a filter support member supporting the filter medium.

15. The upright vacuum cleaner as set forth in claim 8, wherein the primary airflow inlet is horizontally oriented and arranged so that the airflow entering the primary cyclone through the primary airflow inlet moves cyclonically within the primary cyclone.

16. The upright vacuum cleaner as set forth in claim 8, wherein the discharge member has an opened upper end and a closed lower end, and the opened upper end is coupled to a peripheral edge of a primary airflow outlet of the discharge member.

17. An upright vacuum cleaner comprising:

a nozzle section including an agitator brush;

a cleaner body hingedly connected to the nozzle section;

a suction source mounted in one of the nozzle section and the cleaner body;

a dust collector positioned in the cleaner body, the dust collector comprising:

a primary cyclone having a cylindrical shape, and at least one secondary cyclone having a cone shape and being integrated with the primary cyclone for separating contaminants from an airflow;

a bottom panel covering an open end of the dust collector;

a main filter assembly located in the dust collector for filtering dust and dirt from the airflow discharged from the secondary cyclone;

a body release pedal for an inclined operative position of the cleaner body, the body release pedal being pivotably mounted on a mounting portion provided at the nozzle section; and a guide rib provided at the primary cyclone for guiding the airflow in a direction tangential to an inner peripheral wall surface of the primary cyclone, wherein the guide rib is inclined to one side of a primary airflow inlet of the primary cyclone according to a shape of a discharge member to prevent the air entering the primary air flow inlet from being directly introduced into a discharge member, wherein said airflow is further directed into said secondary cyclone which allows said airflow to enter said discharge member from the top of said discharge member.

18. The upright vacuum cleaner as set forth in claim 17, wherein the secondary cyclone is disposed around the primary cyclone.

19. The upright vacuum cleaner as set forth in claim 17, wherein secondary cyclones are partitioned from each other by side walls of the secondary cyclone.

20. The upright vacuum cleaner as set forth in claim 17, wherein the dust collector further comprises a dust collecting container including a primary dust storing part and a secondary dust storing part being airtightly separated from each other.

* * * * *